US008208646B2

(12) United States Patent
Relyea et al.

(10) Patent No.: US 8,208,646 B2
(45) Date of Patent: Jun. 26, 2012

(54) AUDIO FILTRATION FOR CONTENT PROCESSING SYSTEMS AND METHODS

(75) Inventors: Don Relyea, Dallas, TX (US); Heath Stallings, Grapevine, TX (US); Brian Roberts, Frisco, TX (US)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 1286 days.

(21) Appl. No.: 11/603,460

(22) Filed: Nov. 22, 2006

(65) Prior Publication Data

US 2008/0120099 A1 May 22, 2008

(51) Int. Cl.
*H04R 29/00* (2006.01)

(52) U.S. Cl. ..... 381/58; 381/56; 381/110

(58) Field of Classification Search ..... 381/2, 56, 381/58, 77, 79, 110, 59, 95, 96, 97, 93
See application file for complete search history.

(56) References Cited

U.S. PATENT DOCUMENTS 6,868,162 B1 * 3/2005 Jubien et al. ..... 381/107
7,103,187 B1 * 9/2006 Neuman ..... 381/59
7,333,618 B2 * 2/2008 Shuttleworth et al. ..... 381/57
7,606,377 B2 * 10/2009 Melanson ..... 381/97
7,908,021 B1 * 3/2011 Bogard ..... 700/94
2001/0037194 A1 * 11/2001 Aarts et al. ..... 704/200
2003/0095669 A1 * 5/2003 Belrose et al. ..... 381/56
2003/0156723 A1 * 8/2003 Ruwisch ..... 381/93
2004/0136538 A1 * 7/2004 Cohen et al. ..... 381/17
2009/0092265 A1 * 4/2009 Lovejoy ..... 381/107

* cited by examiner

*Primary Examiner* — Vivian Chin
*Assistant Examiner* — Friedrich W Fahnert

(57) ABSTRACT

In one of many possible embodiments, a method includes providing an audio output signal to an output device for broadcast to a user, receiving audio input, the audio input including user voice input provided by the user and audio content broadcast by the output device in response to receiving the audio output signal, applying at least one predetermined calibration setting, and filtering the audio input based on the audio output signal and the predetermined calibration setting. In some examples, the calibration setting may be determined in advance by providing a calibration audio output signal to the output device for broadcast, receiving calibration audio input, the calibration audio input including calibration audio content broadcast by the output device in response to receiving the calibration audio output signal, and determining the calibration setting based on at least one difference between the calibration audio output signal and the calibration audio input.

26 Claims, 8 Drawing Sheets

AUDIO FILTRATION FOR CONTENT PROCESSING SYSTEMS AND METHODS

BACKGROUND INFORMATION

The advent of computers, interactive electronic communication, and other advances in the realm of consumer electronics have resulted in a great variety of options for experiencing content such as media and communication content. A slew of electronic devices are able to present such content to their users.

However, presentations of content can introduce challenges in other areas of content processing. For example, an electronic device that broadcasts audio content may compound the difficulties normally associated with receiving and processing user voice input. For instance, broadcast audio often creates or adds to the noise present in an environment. The noise from broadcast audio can undesirably introduce an echo or other form of interference into input audio, thereby increasing the challenges associated with distinguishing user voice input from other audio signals present in an environment.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical reference numbers designate identical or similar elements.

DETAILED DESCRIPTION OF PREFERRED EMBODIMENTS

I. Introduction

Figure 1:
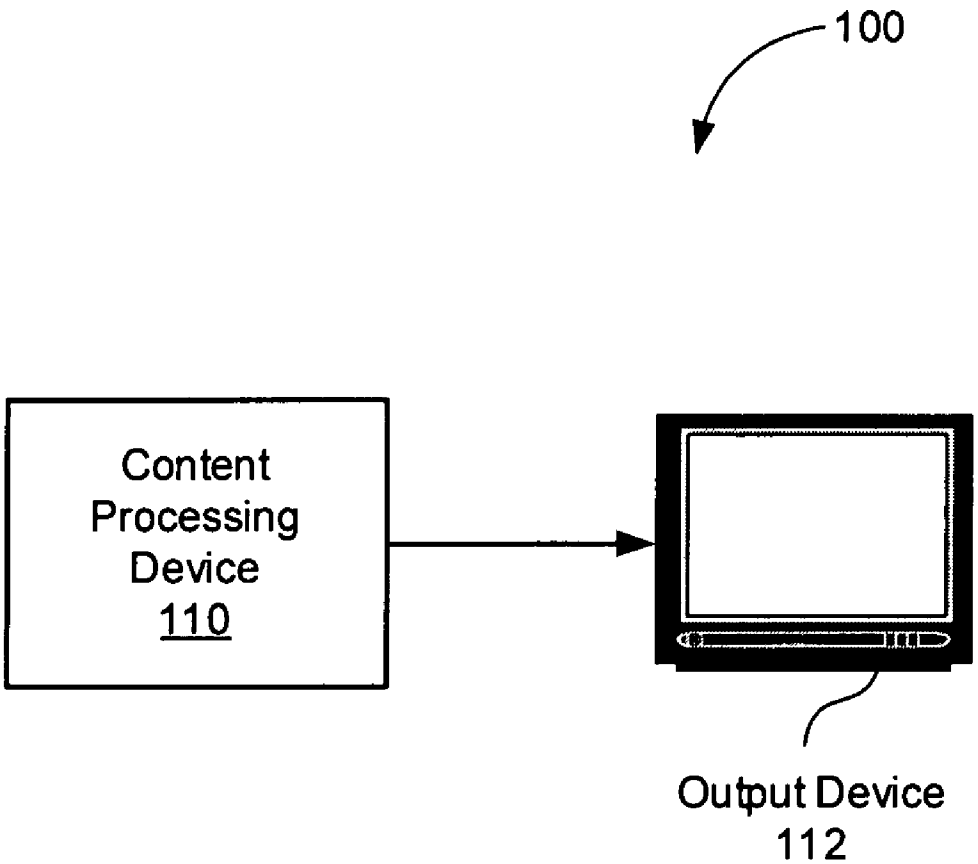
FIG. 1 illustrates an example of a content processing system.

Exemplary systems and methods for processing audio content are described herein. In the exemplary systems and methods, an audio output signal may be provided to an output device for broadcast to a user. Audio input (e.g., sound waves) may be received and may include at least a portion of the audio content broadcast by the output device. The audio input may also include user voice input provided by the user.

The audio input may be filtered. In particular, the audio input may be filtered to identify the user voice input. This may be done by removing audio noise from the audio input in order to isolate, or substantially isolate, the user voice input.

The filtration performed on the audio input may be based on the audio output signal and at least one predetermined calibration setting. The audio output signal may be used to account for the audio content provided to the output device for broadcast. The predetermined calibration setting may estimate and account for differences between the audio content as defined by the audio output signal and the audio content actually broadcast by the output device. Such differences may be commonly introduced into broadcast audio due to characteristics of an output device and/or an audio environment. For example, equalization settings of an output device may modify the audio output content, or a propagation delay may exist between the time an audio output signal is provided to the output device and the time that the audio input including the corresponding broadcast audio is received.

The predetermined calibration setting may include data representative of one or more attributes of audio content, including frequency, attenuation, amplitude, phase, and time data. The calibration setting may be determined before the audio input is received. In certain embodiments, the calibration setting is determined by performing a calibration process that includes providing a calibration audio output signal to the output device for broadcast, receiving calibration audio input including at least a portion of the calibration audio broadcast by the output device, determining at least one difference between the calibration audio output signal and the calibration audio input, and setting at least one calibration setting based on the determined difference(s). The calibration setting (s) may be used to filter audio input that is received after the calibration process has been performed.

By determining and using a calibration setting together with data representative of an audio output signal to filter audio input, actual broadcast audio included in the audio input can be accurately estimated and removed. Accordingly, audio content may be broadcast while user voice input is received and processed, without the broadcast audio interfering with or compromising the ability to receive and identify the user voice input. The calibration setting(s) may also account for and be used to remove environmental noise included in audio input.

Components and functions of exemplary content processing systems and methods will now be described in more detail.

II. Exemplary System View

FIG. 1 illustrates an example of a content processing system 100. As shown in FIG. 1, content processing system 100 may include a content processing device 110 communicatively coupled to an output device 112. The content processing device 110 may be configured to process content and provide an output signal carrying the content to an output device 112 such that the output device 112 may present the content to a user.

The content processed and provided by the content processing device 110 may include any type or form of electronically represented content (e.g., audio content). For example, the content processed and output by the content processing device 110 may include communication content (e.g., voice communication content) and/or media content such as a media content instance, or at least a component of the media content instance. Media content may include any television program, on-demand program, pay-per-view program, broadcast media program, video-on demand program, commercial, advertisement, video, multimedia, movie, song, audio programming, gaming program (e.g., a video game), or any segment, portion, component, or combination of these or other forms of media content that may be presented to and experienced by a user. A media content instance may have one or more components. For example, an exemplary media content instance may include a video component and/or an audio component.

The presentation of the content may include, but is not limited to, displaying, playing back, broadcasting, or otherwise presenting the content for experiencing by a user. The content typically includes audio content (e.g., an audio component of media or communication content), which may be broadcast by the output device 112.

The content processing device 110 may be configured to receive and process audio input, including user voice input. The audio input may be in the form of sound waves captured by the content processing device 110.

The content processing device 110 may filter the audio input. The filtration may be based on the audio output signal provided to the output device 112 and at least one predetermined calibration setting. As described below, use of the audio output signal and the predetermined calibration setting estimates the audio content broadcast by the output device 112, thereby taking into account any estimated differences between the audio output signal and the audio content actually broadcast by the output device 112. Exemplary processes for determining calibration settings and using the settings to filter audio input are described further below.

While an exemplary content processing system 100 is shown in FIG. 1, the exemplary components illustrated in FIG. 1 are not intended to be limiting. Indeed, additional or alternative components and/or implementations may be used, as is well known. Each of the components of system 100 will now be described in additional detail.

A. Output Device

As mentioned, the content processing device 110 may be communicatively coupled to an output device 112 configured to present content for experiencing by a user. The output device 112 may include one or more devices or components configured to present content (e.g., media and/or communication content) to the user, including a display (e.g., a display screen, television screen, computer monitor, handheld device screen, or any other device configured to display content), an audio output device such as speaker 123 shown in FIG. 2, a television, and any other device configured to at least present audio content. The output device 112 may receive and process output signals provided by the content processing device 110 such that content included in the output signals is presented for experiencing by the user.

The output device 112 may be configured to modify audio content included in an audio output signal received from the content processing device 110. For example, the output device 112 may amplify or attenuate the audio content for presentation. By way of another example, the output device 112 may modify certain audio frequencies one way (e.g., amplify) and modify other audio frequencies in another way (e.g., attenuate or filter out). The output device 112 may be configured to modify the audio content for presentation in accordance with one or more equalization settings, which may be set by a user of the output device 112.

While FIG. 1 illustrates the output device 112 as being a device separate from and communicatively connected to the content processing device 110, this is exemplary only and not limiting. In other embodiments, the output device 112 and the content processing device 110 may be integrated into one physical device. For example, the output device 112 may include a display and/or speaker integrated in the content processing device 110.

B. Content Processing Device

Figure 2:
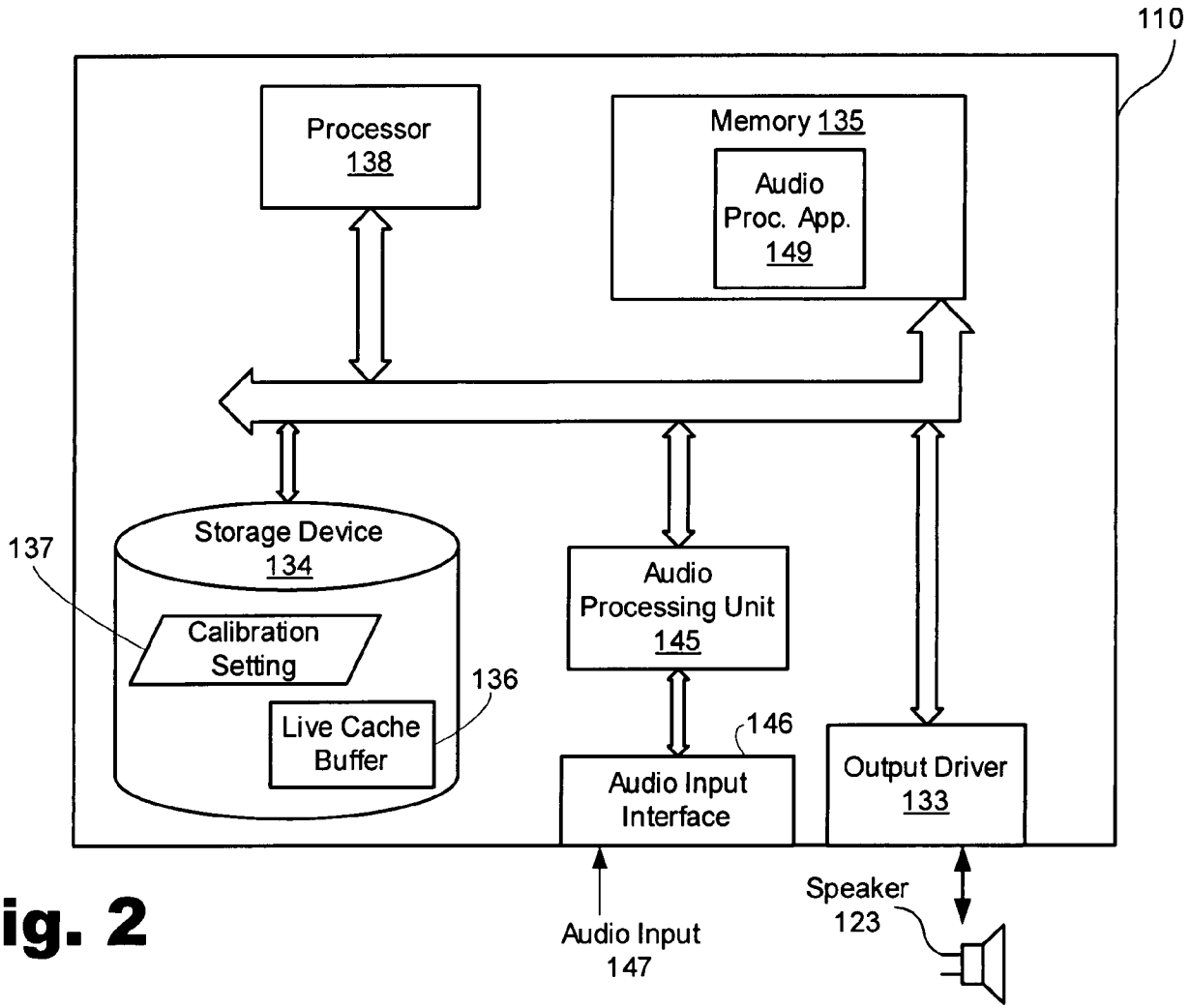
FIG. 2 is an illustration of an exemplary content processing device.

FIG. 2 is a block diagram of an exemplary content processing device 110. The content processing device 110 may include any combination of hardware, software, and firmware configured to process content, including providing an output signal carrying content (e.g., audio content) to an output device 112 for presentation to a user. For example, an exemplary content processing device 110 may include, but is not limited to, an audio-input enabled set-top box ("STB"), home communication terminal ("HCT"), digital home communication terminal ("DHCT"), stand-alone personal video recorder ("PVR"), digital video disc ("DVD") player, personal computer, telephone (e.g., VoIP phone), mobile phone, personal digital assistant ("PDA"), gaming device, entertainment device, portable music player, audio broadcasting device, vehicular entertainment device, and any other device capable of processing and providing at least audio content to an output device 112 for presentation.

The content processing device 110 may also be configured to receive audio input, including user voice input provided by a user. The content processing device 110 may be configured to process the audio input, including filtering the audio input. As described below, filtration of the audio input may be based on a corresponding audio output signal provided by the content processing device 110 and at least one predetermined calibration setting.

In certain embodiments, the content processing device 110 may include any computer hardware and/or instructions (e.g., software programs), or combinations of software and hardware, configured to perform the processes described herein. In particular, it should be understood that content processing device 110 may be implemented on one physical computing device or may be implemented on more than one physical computing device. Accordingly, content processing device 110 may include any one of a number of well known computing devices, and may employ any of a number of well known computer operating systems, including, but by no means limited to, known versions and/or varieties of the Microsoft Windows® operating system, the Unix operating system, Macintosh® operating system, and the Linux operating system.

Accordingly, the processes described herein may be implemented at least in part as instructions executable by one or more computing devices. In general, a processor (e.g., a microprocessor) receives instructions, e.g., from a memory, a computer-readable medium, etc., and executes those instructions, thereby performing one or more processes, including one or more of the processes described herein. Such instructions may be stored and transmitted using a variety of known computer-readable media.

A computer-readable medium (also referred to as a processor-readable medium) includes any medium that participates in providing data (e.g., instructions) that may be read by a computer (e.g., by a processor of a computer). Such a medium may take many forms, including, but not limited to, non-volatile media, volatile media, and transmission media. Non-volatile media may include, for example, optical or magnetic disks and other persistent memory. Volatile media may include, for example, dynamic random access memory (DRAM), which typically constitutes a main memory. Transmission media may include, for example, coaxial cables, copper wire and fiber optics, including the wires that comprise a system bus coupled to a processor of a computer. Transmission media may include or convey acoustic waves, light waves, and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

While an exemplary content processing device 110 is shown in FIG. 2, the exemplary components illustrated in FIG. 2 are not intended to be limiting. Indeed, additional or alternative components and/or implementations may be used. For example, components and functionality of the content processing device 110 may be implemented in the exemplary systems and methods described in co-pending U.S. patent application Ser. No. 11/603,461, entitled "Audio Processing For Media Content Access Systems and Methods," filed the same day as the present application and hereby fully incorporated herein by reference in its entirety. Various components of the content processing device 110 will now be described in additional detail.

1. Communication Interfaces

As shown in FIG. 2, the content processing device 110 may include an output driver 133 configured to interface with or drive an output device 112 such as a speaker 123. For example, the output driver 133 may provide an audio output signal to the speaker 123 for broadcast to a user. The output driver 133 may include any combination of hardware, software, and firmware as may serve a particular application.

The content processing device 110 may also include an audio input interface 146 configured to receive audio input 147. The audio input interface 146 may include any hardware, software, and/or firmware for capturing or otherwise receiving sound waves. For example, the audio input interface 146 may include a microphone and an analog to digital converter ("ADC") configured to receive and convert audio input 147 to a useful format. Exemplary processing of the audio input 147 will be described further below.

2. Storage Devices

Storage device 134 may include one or more data storage media, devices, or configurations and may employ any type, form, and combination of storage media. For example, the storage device 134 may include, but is not limited to, a hard drive, network drive, flash drive, magnetic disc, optical disc, or other non-volatile storage unit. Various components or portions of content may be temporarily and/or permanently stored in the storage device 134.

Figure 3:
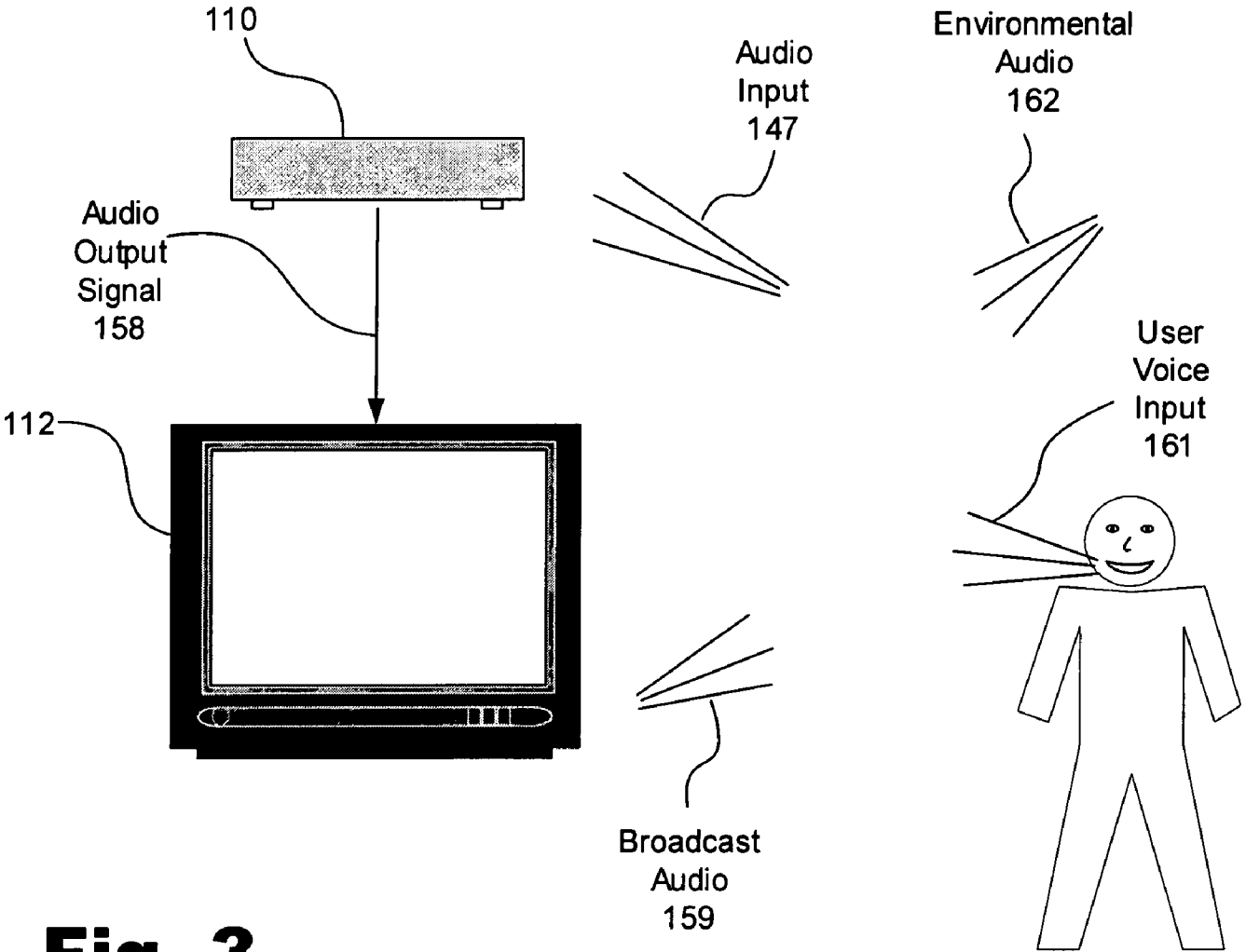
FIG. 3 illustrates an example of audio signals in an exemplary content processing environment.

The storage device 134 of FIG. 3 is shown to be a part of the content processing device 110 for illustrative purposes only. It will be understood that the storage device 134 may additionally or alternatively be located external to the content processing device 110.

The content processing device 110 may also include memory 135. Memory 135 may include, but is not limited to, FLASH memory, random access memory ("RAM"), dynamic RAM ("DRAM"), or a combination thereof. In some examples, as will be described in more detail below, various applications (e.g., an audio processing application) used by the content processing device 110 may reside in memory 135.

As shown in FIG. 2, the storage device 134 may include one or more live cache buffers 136. The live cache buffer 136 may additionally or alternatively reside in memory 135 or in a storage device external to the content processing device 110.

As will be described in more detail below, data representative of or associated with content being processed by the content processing device 110 may be stored in the storage device 134, memory 135, or live cache buffer 136. For example, data representative of and/or otherwise associated with an audio output signal provided to the output device 112 by the content processing device 110 may be stored by the content processing device 110. The stored output data can be used for processing (e.g., filtering) audio input 147 received by the content processing device 110, as described below.

The storage device 134, memory 135, or live cache buffer 136 may also be used to store data associated with the calibration processes described herein. For example, data representative of one or more predefined calibration output signals may be stored for use in the calibration process. Calibration settings may also be stored for future use in filtration processes. In certain examples, the storage device 134 may include a library of calibration settings from which the content processing device 110 can select. An exemplary calibration setting stored in storage device 134 is represented as reference number 137 in FIG. 2.

3. Processors

As shown in FIG. 2, the content processing device 110 may include one or more processors, such as processor 138 configured to control the operations of the content processing device 110. The content processing device 110 may also include an audio processing unit 145 configured to process audio data. The audio processing unit 145 and/or other components of the content processing device 110 may be configured to perform any of the audio processing functions described herein. The audio processing unit 145 may process an audio component of media or communication content, including providing the audio component to the output device 112 for broadcast to a user. The audio component may be provided to the output device 112 via the output driver 133.

The audio processing unit 145 may be further configured to process audio input 147 received by the audio input interface 146, including filtering the audio input 147 in any of the ways described herein. The audio processing unit 145 may be configured to process audio data in digital and/or analog form. Exemplary audio processing functions will be described further below.

4. Application Clients

One or more applications residing within the content processing device 110 may be executed automatically or upon initiation by a user of the content processing device 110. The applications, or application clients, may reside in memory 135 or in any other area of the content processing device 110 and be executed by the processor 138.

As shown in FIG. 2, the content processing device 110 may include an audio processing application 149 configured to process audio content, including instructing the audio processing unit 145 and/or processor 138 of the content processing device 110 to perform any of the audio processing functions described herein.

To facilitate an understanding of the audio processing application 149, FIG. 3 illustrates an example of audio signals in an exemplary content processing environment. As shown in FIG. 3, various audio signals may be present in the environment. For example, the content processing device 110 may be configured to process an audio signal such as an audio component of a media content instance and/or a communication signal. In processing the audio signal, the audio processing unit 145 and/or the audio processing application 149 may process any data representative of and/or associated with the audio signal, including storing such data to memory, as mentioned above. For example, in relation to providing an audio output signal to an output device 112, the audio processing unit 145 may be configured to store data representative of the audio output signal (e.g., amplitude, attenuation, phase, time, and frequency data), as well as any other data related to the audio output signal. The stored audio output data may be used in processing audio input 147 received by the audio input interface 146, as described below.

As shown in FIG. 3, the content processing device 110 may provide an audio output signal 158 to an output device 112 configured to broadcast audio content included in the audio output signal 158 as broadcast audio 159. Accordingly, the environment shown in FIG. 3 may include broadcast audio 159, which may include actual broadcast signals (i.e., broadcast sound waves) representative of an audio component of a media content instance, a communication signal, or other type of content being presented to the user.

As shown in FIG. 3, the user may provide user voice input 161. Accordingly, signals (e.g., sound waves) representative of user voice input 161 may be present in the environment. In some examples, the user voice input 161 may be vocalized during broadcast of the broadcast audio 159.

As shown in FIG. 3, environmental audio 162 may also be present in the environment. The environmental audio 162 may include any audio signal other than the broadcast audio 159 and the user voice input 161, including signals produced by an environment source. The environmental audio 162 may also be referred to as background noise. At least some level of background noise may be commonly present in the environment shown in FIG. 3.

Any portion and/or combination of the audio signals present in the environment may be received (e.g., captured) by the audio input interface 146 of the content processing device 110. The audio signals detected and captured by the audio input interface 146 are represented as audio input 147 in FIG. 3. The audio input 147 may include user voice input 161, broadcast audio 159, environmental audio 162, or any combination or portion thereof.

The content processing device 110 may be configured to filter the audio input 147. Filtration of the audio input 147 may be designed to enable the content processing device 110 to identify the user voice input 161 included in the audio input 147. Once identified, the user voice input 161 may be utilized by an application running on either the content processing device 110 or another device communicatively coupled to the content processing device 110. For example, identified user voice input 161 may be utilized by the voice command or communication applications described in the above noted co-pending U.S. Patent Application entitled "Audio Processing For Media Content Access Systems and Methods."

Filtration of the audio input 147 may be based on the output audio signal 158 and at least one predetermined calibration setting, which may be applied to the audio input 147 in any manner configured to remove matching data from the audio input 147, thereby isolating, or at least substantially isolating, the user voice input 161. The calibration setting and the audio output signal 158 may be used to estimate and remove the broadcast audio 159 that is included in the audio input 147.

Use of a predetermined calibration setting in a filtration of the audio input 147 generally improves the accuracy of the filtration process as compared to a filtration process that does utilize a predetermined calibration setting. The calibration setting is especially beneficial in configurations in which the content processing device 110 is unaware of differences between the audio output signal 158 and the actually broadcast audio 159 included in the audio input 147 (e.g., configurations in which the content processing device 110 and the output device 112 are separate entities). For example, a simple subtraction of the audio output signal 158 from the audio input 147 does not account for differences between the actually broadcast audio 159 and the audio output signal 158. In some cases, the simple subtraction approach may make it difficult or even impossible for the content processing device 110 to accurately identify user voice input 161 included in the audio input 147.

For example, the audio output signal 158 may include audio content signals having a range of frequencies that includes base-level frequencies. The output device 112 may include equalization settings configured to accentuate (e.g., amplify) the broadcast of base-level frequencies. Accordingly, base-level frequencies included in the audio output signal 158 may be different in the broadcast audio 159, and a simple subtraction of the audio output signal 158 from the input audio 147 would be inaccurate at least because the filtered input audio 147 would still include the accentuated portions of the base-level frequencies. The remaining portions of the base-level frequencies may evidence themselves as a low-frequency hum in the filtered audio input 147 and may jeopardize the content processing device 110 being able to accurately identify the user voice input 161.

Propagation delays may also affect the accuracy of the simple subtraction approach. Although small, there is typically a delay between the time that the content processing device 110 provides the audio output signal 158 to the output device 112 and the time that the associated broadcast audio 159 is received as part of the audio input 147. Although the delay is small, it may, if not accounted for, jeopardize the ability of the content processing device 110 to identify the user voice input 161 included in the audio input 147 at least because a non-corresponding portion of the audio output signal 158 may be applied to the audio input 147.

Use of predetermined calibration settings in the filtration process can account for and overcome (or at least mitigate) the above-described effects caused by differences between the audio output signal 158 and the broadcast audio 159. The predetermined calibration settings may include any data representative of differences between a calibration audio output signal and calibration audio input, which differences may be determined by performing a calibration process.

The calibration process may be performed at any suitable time and/or as often as may best suit a particular implementation. In some examples, the calibration process may be performed when initiated by a user, upon launching of an application configured to utilize user voice input, periodically, upon power-up of the content processing device 110, or upon the occurrence of any other suitable pre-determined event. The calibration process may be performed frequently to increase accuracy or less frequently to minimize interference with the experience of the user.

The calibration process may be performed at times when the audio processing application 149 may take over control of audio output signals without unduly interfering with the experience of the user and/or at times when background noise is normal or minimal. The calibration process may include providing instructions to the user concerning controlling background noise during performance of the calibration process. For example, the user may be instructed to eliminate or minimize background noise that is unlikely to be present during normal operation of the content processing device 110.

Figure 4:
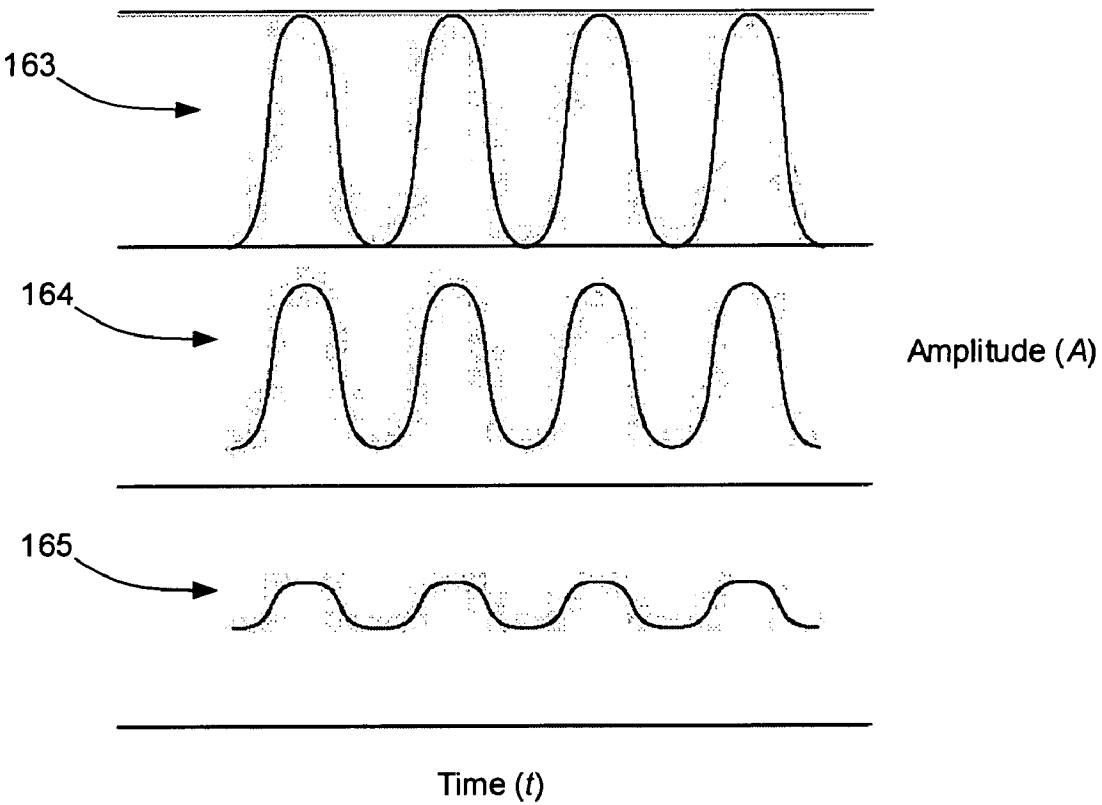
FIG. 4 illustrates exemplary waveforms associated with an audio output signal provided by the content processing device of FIG. 2 to an output device and broadcast by the output device.

In certain embodiments, the calibration process includes the content processing device 110 providing a predefined calibration audio output signal 158 to the output device 112 for broadcast. FIG. 4 illustrates an exemplary calibration audio output signal 158 represented as waveform 163 plotted on a graph having time (t) on the x-axis and amplitude (A) on the y-axis. The output device 112 broadcasts the calibration audio output signal 158 as calibration broadcast audio 159. The content processing device 110 receives calibration audio input 147, which includes at least a portion of the calibration broadcast audio 159 broadcast by the output device 112. The calibration audio input 147 may also include calibration environmental audio 162 that is present during the calibration process. The calibration audio input 147 is represented as waveform 164 in FIG. 4.

As part of the calibration process, the content processing device 110 may determine differences between waveform 163 and waveform 164 (i.e., differences between the calibration audio output signal 158 and the calibration audio input 147). The determination may be made using any suitable technologies, including subtracting one waveform from the other or inverting and adding one waveform to the other. Waveform 165 of FIG. 4 is a graphical representation of the determined differences in amplitude and frequency between waveform 163 and waveform 164. Such differences may be caused by equalization settings of the output device 112, as described above.

From the determined differences (e.g., from waveform 165), the content processing device 110 can determine one or more calibration settings to be used in filtering audio input 147 received after completion of the calibration process. The calibration settings may include any data representative of the determined differences between the calibration audio output signal 158 and the calibration audio input 147. Examples of data that may be included in the calibration settings include, but are not limited to, propagation delay, amplitude, attenuation, phase, time, and frequency data.

The calibration settings may be representative of equalization settings (e.g., frequency and amplitude settings) of the output device 112 that introduce differences into the calibration broadcast audio 159. The calibration settings may also account for background noise that is present during the calibration process. Accordingly, the calibration settings can improve the accuracy of identifying user voice input in situations where the same or similar background noise is also present during subsequent audio processing operations.

Figure 5:
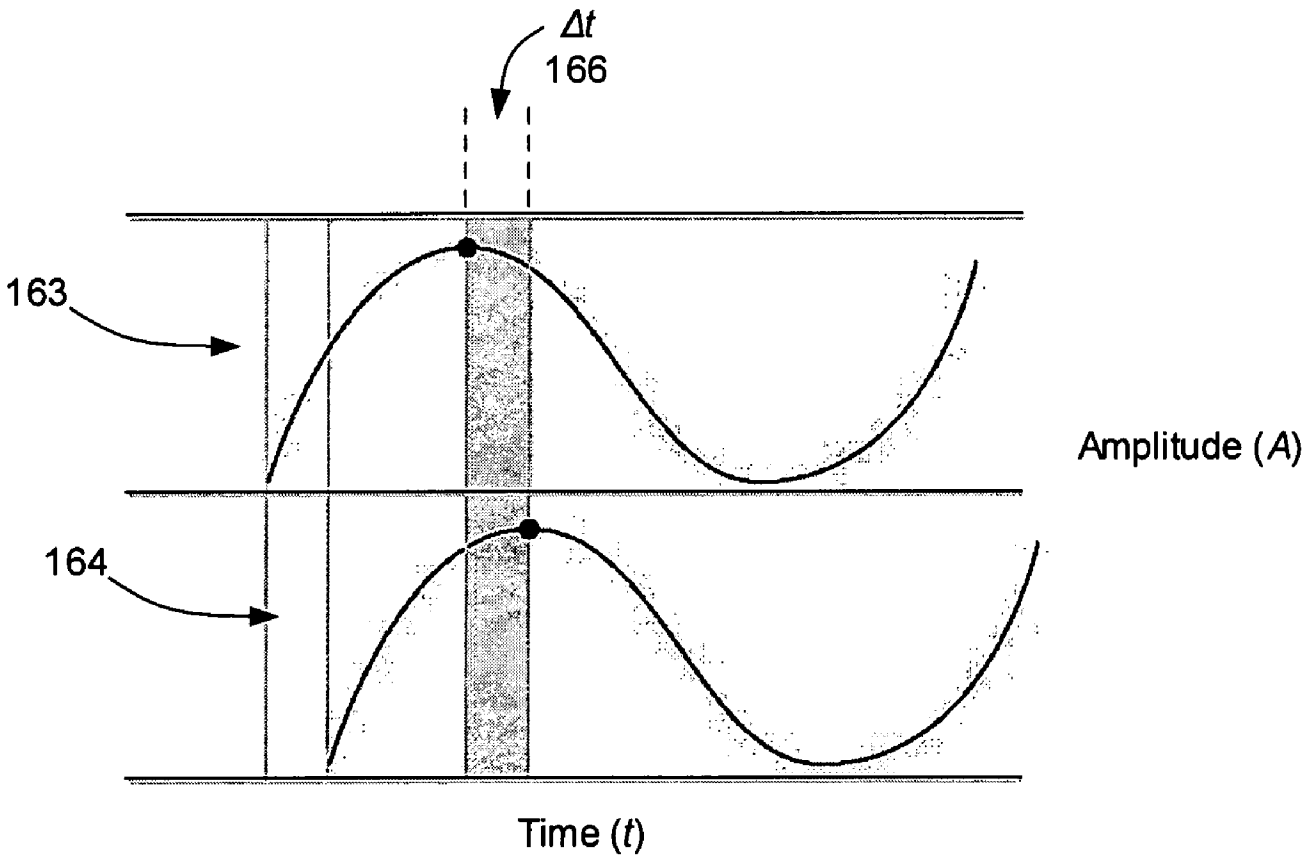
FIG. 5 illustrates exemplary waveforms associated with an audio output signal provided by and input audio received by the content processing device of FIG. 2.

The calibration settings may include data representative of a propagation delay between the time that the calibration audio output signal 158 is provided to the output device 112 and the time that the calibration input audio 147 is received by the content processing device 110. The content processing device 110 may determine the propagation delay from waveforms 163 and 164. This may be accomplished using any suitable technologies. In certain embodiments, the content processing device 110 may be configured to perform a peak analysis on waveforms 163 and 164 to approximate a delay between peaks of the waveforms 163 and 164. FIG. 5 illustrates waveform 163 and waveform 164 plotted along a common time (t) axis and having amplitude (A) on the y-axis. The content processing device 110 can determine a calibration delay 166 by determining the time difference (i.e., $\Delta t$) between a peak of waveform 163 and a corresponding peak of waveform 164. In post-calibration processing, the calibration delay 166 may serve as an estimation of the amount of time it may generally take for an audio output signal 158 provided by the content processing device 110 to propagate and be received by the content processing device 110 as part of audio input 147. The content processing device 110 may store data representative of the calibration delay and/or other calibration settings for future use.

The above-described exemplary calibration process may be performed in the same or similar environment in which the content processing device 110 will normally operate. Consequently, the calibration settings may generally provide an accurate approximation of differences between an audio output signal 158 and the corresponding broadcast audio 159 included in the input audio 147 being processed. The calibration settings may account for equalization settings that an output device 112 may apply to the audio output signal 158, as well as the time it may take the audio content included in the audio output signal 158 to be received as part of audio input 147.

Figure 6:
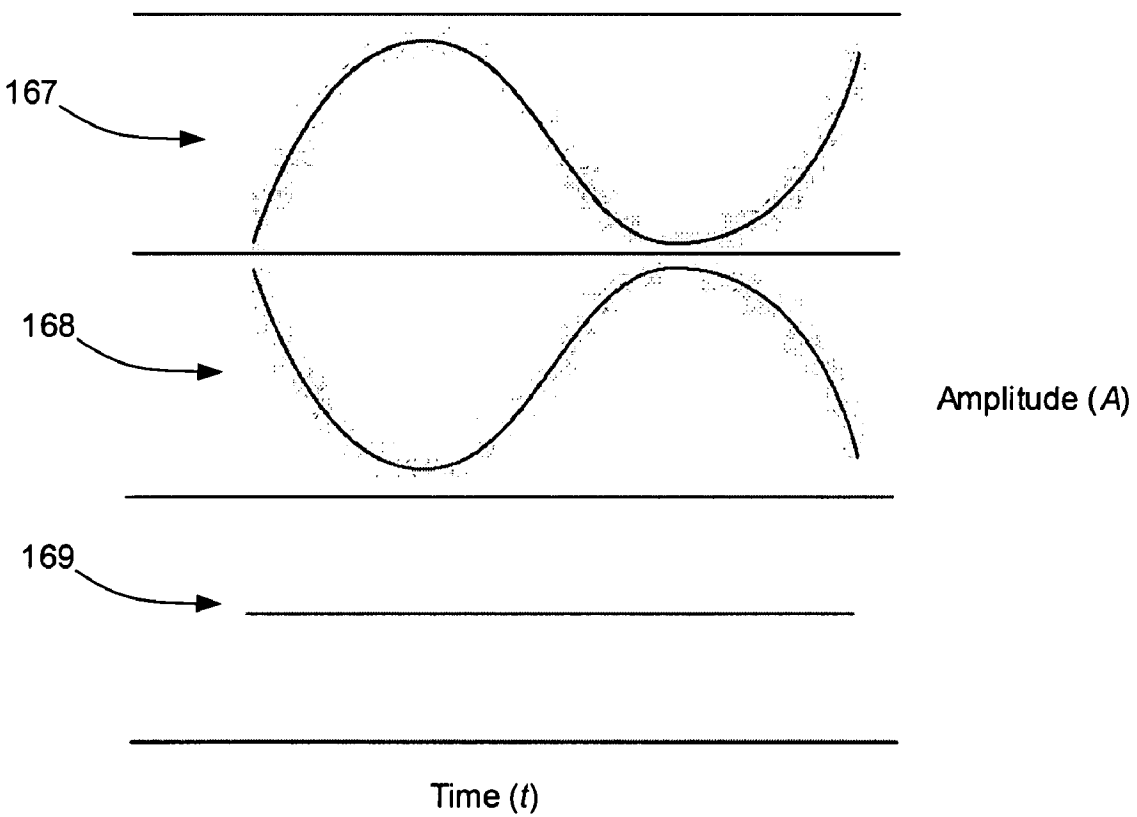
FIG. 6 illustrates an exemplary application of an inverted waveform canceling out another waveform.

Once calibration settings have been determined, the content processing device 110 can utilize the calibration settings to filter subsequently received audio input 147. The filtration may include applying data representative of at least one calibration setting and the audio output signal 158 to the corresponding audio input 147 in any manner that acceptably filters matching data from the audio input 147. In certain embodiments, for example, data representative of the calibration setting and the audio output signal 158 may be subtracted from data representative of the audio input 147. In other embodiments, data representative of the calibration setting and the audio output signal 158 may be combined to generate a resulting waveform, which is an estimation of the broadcast audio 159. Data representative of the resulting waveform may be subtracted from or inverted and added to data representative of the audio input 147. Such applications of the calibration setting and the audio output signal 158 to the audio input 147 effectively cancel out matching data included in the audio input 147. FIG. 6 illustrates cancellation of a waveform 167 by adding the inverse waveform 168 to the waveform 167 to produce sum waveform 169. FIG. 6 illustrates waveforms 167, 168, and 169 on a graph having common time (t) on the x-axis and amplitude (A) on the y-axis.

Use of a calibration setting to filter audio input 147 may include applying a predetermined calibration delay setting. The calibration delay setting may be applied in any suitable manner that enables the content processing device 110 to match an audio output signal 158 to the corresponding audio input 147. In some examples, the content processing device 110 may be configured to time shift the audio output signal 158 (or the combination of the audio output signal 158 and other calibration settings) by the value or approximate value of the predetermined calibration delay. Alternatively, the input audio 147 may be time shifted by the negative value of the predetermined calibration delay. By applying the calibration delay setting, the corresponding output audio signal 158 and audio input 147 (i.e., the instance of audio input 147 including the broadcast audio 159 associated with output audio signal 158) can be matched up for filtering.

By applying the appropriate audio output signal 158 and calibration setting to the input audio 147, audio signals included in the input audio 147 and matching the audio output signal 158 and calibration setting are canceled out, thereby leaving other audio signals in the filtered audio input 147. The remaining audio signals may include user voice input 161. In this manner, user voice input 161 may be generally isolated from other components of the audio input 147. The content processing device 110 is then able to recognize and accurately identify the user voice input 161, which may be used as input to other applications (e.g., communication and voice command applications). Any suitable technologies for identifying user voice input may be used.

By filtering the audio input 147 based on at least one predetermined calibration setting and the corresponding audio output signal 158, the content processing device 110 may be said to estimate and cancel the actually broadcast audio 159 from the input audio 147. The estimation generally accounts for differences between an electronically represented audio output signal 158 and the corresponding broadcast audio 159 that is actually broadcast as sound waves and included in the audio input 147. The filtration can account for time delays, equalization settings, environmental audio 162, and any other differences detected during performance of the calibration process.

The content processing device 110 may also be configured to perform other filtering operations to remove other noise from the audio input 147. Examples of filters that may be employed include, but are not limited to, anti-aliasing, smoothing, high-pass, low-pass, band-pass, and other known filters.

Processing of the audio input 147, including filtering the audio input 147, may be performed repeatedly and continually when the audio processing application 149 is executing. For example, processing of the audio input 147 may be continuously performed on a frame-by-frame basis. The calibration delay may be used as described above to enable the correct frame of an audio output signal 158 to be removed from the corresponding frame of audio input 147.

The above-described audio processing functionality generally enables the content processing device 110 to accurately identify user voice input 161 even while the content processing device 110 provides audio content for experiencing by the user, without the presentation of audio content unduly interfering with the accuracy of user voice input identifications.

III. Exemplary Process Views

Figure 7:
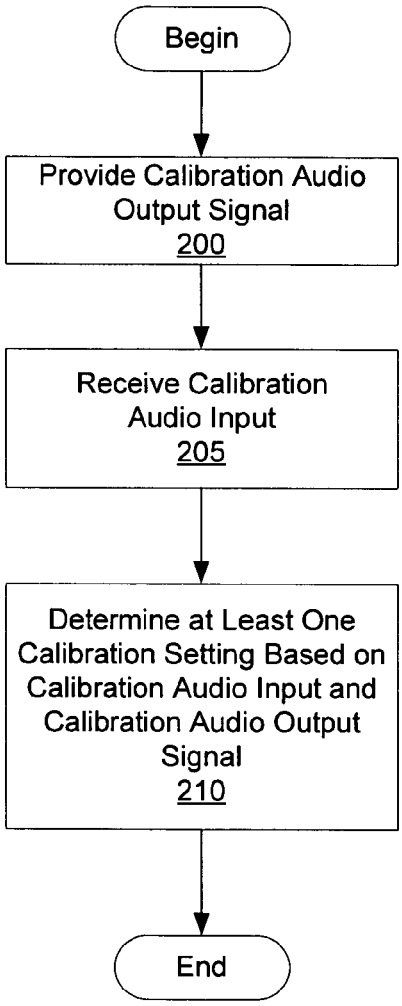
FIG. 7 illustrates an exemplary method of determining at least one calibration setting.

FIG. 7 illustrates an exemplary calibration process. While FIG. 7 illustrates exemplary steps according to one embodiment, other embodiments may omit, add to, reorder, and/or modify any of the steps shown in FIG. 7.

In step 200, a calibration audio output signal is provided. Step 200 may be performed in any of the ways described above, including the content processing device 110 providing the calibration audio output signal to an output device 112 for presentation (e.g., broadcast).

In step 205, calibration audio input is received. Step 205 may be performed in any of the ways described above, including the audio interface 146 of the content processing device 110 capturing calibration audio input. The calibration audio input includes at least a portion of the calibration audio content broadcast by the output device 112 in response to the output device 112 receiving the calibration output signal from the content processing device 110.

In step 210, at least one calibration setting is determined based on the calibration audio input and the calibration audio output signal. Step 210 may be performed in any of the ways described above, including subtracting one waveform from another to determine differences between the calibration audio output signal and the calibration audio input. The differences may be used to determine calibration settings such as frequency, amplitude, and time delay settings. The calibration settings may be stored by the content processing device 110 and used to filter subsequently received audio input.

Figure 8:
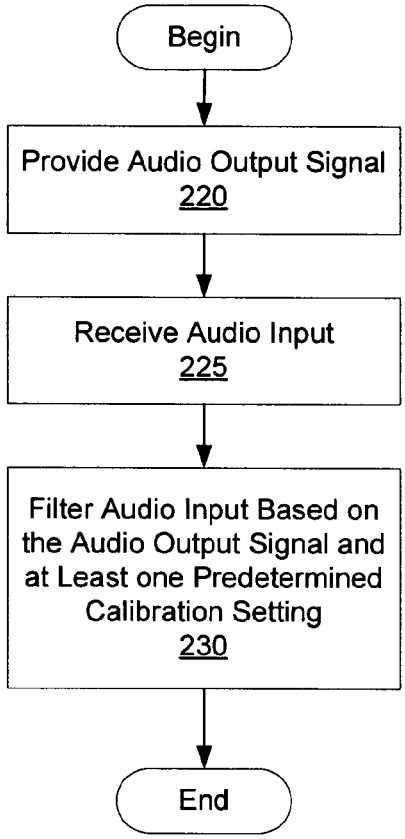
FIG. 8 illustrates an exemplary method of processing audio content.

FIG. 8 illustrates an exemplary method of processing audio content. While FIG. 8 illustrates exemplary steps according to one embodiment, other embodiments may omit, add to, reorder, and/or modify any of the steps shown in FIG. 8. The method of FIG. 8 may be performed after at least one calibration setting has been determined in the method of FIG. 7.

In step 220, an audio output signal is provided. Step 220 may be performed in any of the ways described above, including content processing device 110 providing an audio output signal 158 to an output device 112 for presentation to a user. The audio output signal 158 may include any audio content processed by the content processing device 110, including, but not limited to, one or more audio components of media content and/or communication content.

In step 225, audio input is received. Step 225 may be performed in any of the ways described above, including the content processing device 310 capturing sound waves. The audio input (e.g., audio input 147) may include user voice input (e.g., user voice input 161), at least a portion of broadcast audio corresponding to the audio output signal 158 (e.g., broadcast audio 159), environmental audio 162, or any combination thereof.

In step 230, the audio input is filtered based on the audio output signal and at least one predetermined calibration setting. The predetermined calibration setting may include any calibration setting(s) determined in step 210 of FIG. 7. Step 230 may be performed in any of the ways described above, including the content processing device 110 using the audio output signal 320 and at least one calibration setting to estimate the broadcast audio 159 and/or environmental audio 162 included in the audio input 147 and cancelling the estimated audio from the audio input 147.

The filtration of the audio input may be designed to identify user voice input that may be included in the audio input. The filtration may isolate, or substantially isolate, the user voice input by using the audio output signal and at least one predetermined calibration setting to estimate and remove broadcast audio and/or environmental audio from the audio input.

The exemplary method illustrated in FIG. 8, or certain steps thereof, may be repeated or performed continuously on different portions (e.g., frames) of audio content.

Figure 9:
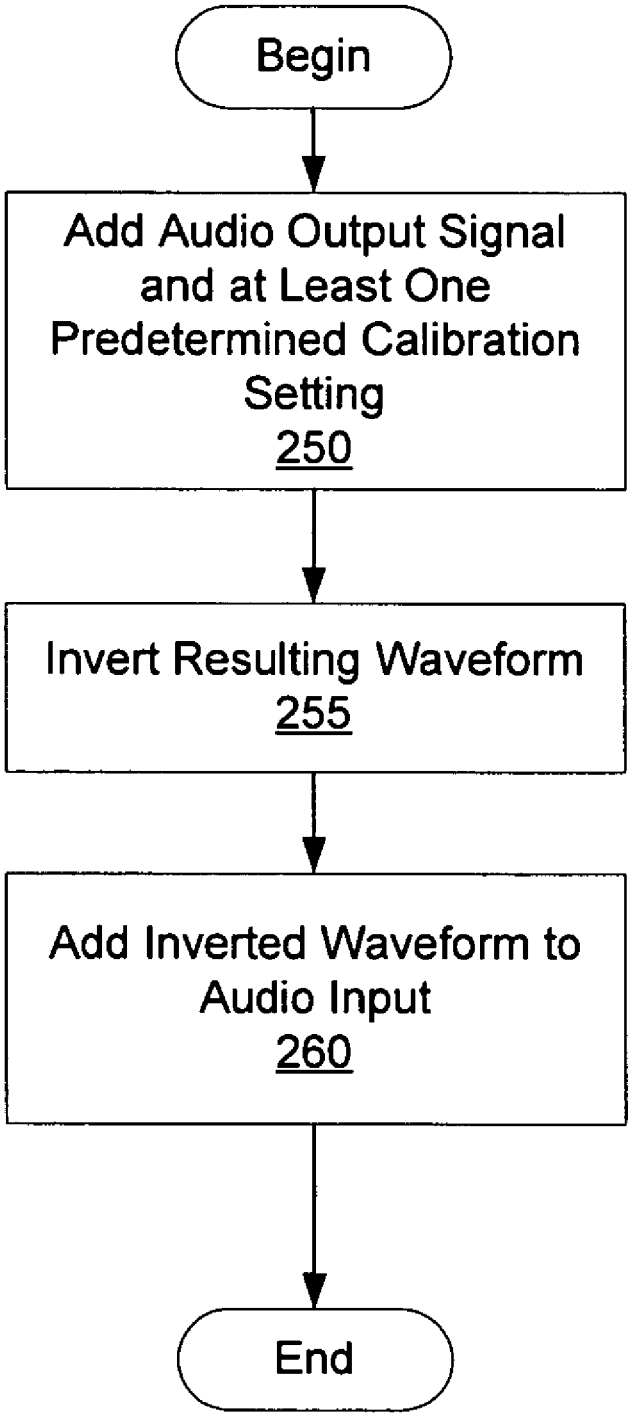
FIG. 9 illustrates an exemplary method of filtering audio input.

FIG. 9 illustrates an exemplary method of filtering audio input. While FIG. 9 illustrates exemplary steps according to one embodiment, other embodiments may omit, add to, reorder, and/or modify any of the steps shown in FIG. 9. The example shown in FIG. 9 is not limiting. Other embodiments may include using different methods of applying an audio output signal and at least one predetermined calibration setting to audio input.

In step 250, an audio output signal and at least one predetermined calibration setting are added together. Step 250 may be performed in any of the ways described above, including adding waveform data representative of the audio output signal and the predetermined calibration setting. Step 250 produces a resulting waveform.

In step 255, the resulting waveform is inverted. Step 255 may be performed in any of the ways described above.

In step 260, the inverted waveform is added to the audio input. Step 260 may be performed in any of the ways described above. Step 260 is designed to cancel data matching the audio output signal and the predetermined calibration setting from the audio input, thereby leaving user voice input for identification and use in other applications.

IV. Alternative Embodiments

The preceding description has been presented only to illustrate and describe exemplary embodiments with reference to the accompanying drawings. It will, however, be evident that various modifications and changes may be made thereto, and additional embodiments may be implemented, without departing from the scope of the invention as set forth in the claims that follow. The above description and accompanying drawings are accordingly to be regarded in an illustrative rather than a restrictive sense.

What is claimed is:

1. A method comprising:

providing, by a content processing device configured to process media content comprising at least one video component and at least one audio component, a calibration audio output signal to a television device for broadcast;

receiving, by the content processing device, calibration audio input, the calibration audio input including calibration audio content broadcast by the television device in response to receiving the calibration audio output signal;

determining, by the content processing device, at least one calibration setting based on at least one difference between the calibration audio output signal and the calibration audio input;

providing, by the content processing device, a subsequent audio output signal to the television device for broadcast to a user;

receiving, by the content processing device, subsequent audio input, the subsequent audio input including user voice input provided by the user and subsequent audio content broadcast by the television device in response to receiving the subsequent audio output signal;

filtering, by the content processing device, the subsequent audio input by:

estimating the subsequent audio content broadcast by the television device based on the subsequent audio output signal and the at least one calibration setting, and removing the subsequent audio content broadcast by the television device from the subsequent audio input to at least partially isolate the user voice input; and providing, by the content processing device, the at least partially isolated user voice input to a voice command application.

2. The method of claim 1, wherein the at least one calibration setting is representative of at least one of a frequency, amplitude, phase, and time difference between the calibration audio output signal and the calibration audio input.

3. The method of claim 1, wherein the at least one calibration setting is representative of a propagation delay between a first time when the calibration audio output signal is provided to the television device for broadcast and a second time when the calibration audio input is received.

4. An apparatus comprising:

an output driver configured to provide an audio output signal to an output device for broadcast to a user and provide a video output signal to the output device for display to the user;

an audio input interface configured to receive audio input, the audio input including user voice input provided by the user and audio content broadcast by the output device in response to receiving the audio output signal;

at least one storage device storing a library having at least one predetermined calibration setting; and at least one processor configured to:

filter the audio input by:

estimating the audio content broadcast by the output device based on the audio output signal and the at least one predetermined calibration setting, and removing the audio content broadcast by the output device from the audio input to at least partially isolate the user voice input; and provide the at least partially isolated user voice input to a voice command application.

5. The apparatus of claim 4, wherein the at least one predetermined calibration setting is representative of an estimated difference between the audio output signal and the corresponding audio content broadcast by the output device.

6. The apparatus of claim 4, wherein the at least one processor is configured to apply data representative of the audio output signal and the at least one predetermined calibration setting to the audio input.

7. The apparatus of claim 4, wherein the at least one processor is configured to estimate the broadcast audio content by combining the audio output signal and the at least one predetermined calibration setting to generate a resulting waveform, the at least one processor being configured to remove the estimated broadcast audio content by applying data representative of the resulting waveform to the audio input.

8. The apparatus of claim 7, wherein the at least one processor is configured to apply data representative of the resulting waveform to the audio input by inverting the resulting waveform and adding the inverted waveform to the audio input.

9. The apparatus of claim 4, wherein the audio input includes environmental audio, the at least one processor being configured to estimate and remove the estimated environmental audio from the audio input based on the at least one predetermined calibration setting.

10. The apparatus of claim 4, wherein the at least one predetermined calibration setting includes a predetermined calibration delay.

11. The apparatus of claim 10, wherein:

the predetermined calibration delay is representative of an estimated propagation delay between a first time when the apparatus provides the audio output signal to the output device and a second time when the apparatus receives the audio input, and the at least one processor is configured to time shift at least one of the audio output signal and the audio input based on the estimated propagation delay.

12. The apparatus of claim 4, wherein the at least one calibration setting is determined in advance by:

the output driver providing a calibration audio output signal to the output device for broadcast;

the audio input interface receiving calibration audio input, the calibration audio input including calibration audio content broadcast by the output device in response to receiving the calibration audio output signal; and the at least one processor determining the at least one predetermined calibration setting based on at least one difference between the calibration audio output signal and the calibration audio input.

13. The apparatus of claim 12, wherein the at least one calibration setting is representative of a propagation delay between a first time when the calibration audio output signal is provided to the output device for broadcast and a second time when the calibration audio input is received.

14. The apparatus of claim 12, wherein the at least one calibration setting is representative of at least one of a frequency, amplitude, phase, and time difference between the calibration audio output signal and the calibration audio input.

15. An apparatus comprising:

a processor configured to process media content comprising at least one video component and at least one audio component;

an output driver communicatively coupled to the processor and configured to provide a calibration audio output signal to a television device for broadcast; and an audio input interface communicatively coupled to the processor and configured to receive calibration audio input, the calibration audio input including calibration audio content broadcast by the television device in response to receiving the calibration audio output signal;

wherein the processor is configured to determine at least one calibration setting based on at least one difference between the calibration audio output signal and the calibration audio input;

wherein the output driver is configured to provide a subsequent audio output signal to the television device for broadcast to a user;

wherein the audio input interface is configured to receive subsequent audio input, the subsequent audio input including user voice input provided by the user and subsequent audio content broadcast by the television device in response to receiving the subsequent audio output signal; and wherein the processor is further configured to:

filter the subsequent audio input by:

estimating the subsequent audio content broadcast by the television device based on the subsequent audio output signal and the at least one calibration setting, and removing the subsequent audio content broadcast by the television device from the subsequent audio input to at least partially isolate the user voice input; and provide the at least partially isolated user voice input to a voice command application.

16. The apparatus of claim 15, wherein the at least one calibration setting is representative of at least one of a frequency, amplitude, phase, and time difference between the calibration audio output signal and the calibration audio input.

17. The apparatus of claim 15, wherein the at least one calibration setting is representative of a propagation delay between a first time when the calibration audio output signal is provided to the television device for broadcast and a second time when the calibration audio input is received.

18. A non-transitory computer-readable medium including instructions configured to direct a content processing device configured to process media content comprising at least one video component and at least one audio component to:

provide a calibration audio output signal to a television device for broadcast;

receive calibration audio input, the calibration audio input including calibration audio content broadcast by the television device in response to receiving the calibration audio output signal;

determine at least one calibration setting based on at least one difference between the calibration audio output signal and the calibration audio input;

provide a subsequent audio output signal to the television device for broadcast to a user;

receive subsequent audio input, the subsequent audio input including user voice input provided by the user and subsequent audio content broadcast by the television device in response to receiving the subsequent audio output signal;

filter the subsequent audio input by:

estimating the subsequent audio content broadcast by the television device based on the subsequent audio output signal and the at least one calibration setting, and removing the subsequent audio content broadcast by the television device from provide the at least partially isolated user voice input to a voice command application.

19. The non-transitory computer-readable medium of claim 18, wherein the at least one calibration setting is representative of at least one of a frequency, amplitude, phase, and time difference between the calibration audio output signal and the calibration audio input.

20. The non-transitory computer-readable medium of claim 18, wherein the at least one calibration setting is representative of a propagation delay between a first time when the calibration audio output signal is provided to the television device for broadcast and a second time when the calibration audio input is received.

21. A method comprising:

providing, by a content processing device, an audio output signal to an output device for broadcast to a user and a video output signal to the output device for display to the user;

receiving, by the content processing device, audio input, the audio input including user voice input provided by the user and audio content broadcast by the output device in response to receiving the audio output signal;

storing, by the content processing device, a library having at least one predetermined calibration setting;

filtering, by the content processing device, the audio input by:

estimating the subsequent audio content broadcast by the output device based on the audio output signal and the at least one calibration setting, and removing the audio content broadcast by the output device from the audio input to at least partially isolate the user voice input; and providing, by the content processing device, the at least partially isolated user voice input to a voice command application.

22. A method comprising:

providing, by a content processing device, an audio output signal to an output device for broadcast to a user;

receiving, by the content processing device, audio input that includes user voice input provided by the user and audio content broadcast by the output device in response to receiving the audio output signal;

filtering, by the content processing device, the audio input by:

estimating the audio content broadcast by the output device based on the audio output signal and at least one calibration setting, and removing the audio content broadcast by the output device from the audio input to at least partially isolate the user voice input; and providing, by the content processing device, the at least partially isolated user voice input to a voice command application.

23. The method of claim 22, wherein the filtering includes applying data representative of the audio output signal and the at least one predetermined calibration setting to the audio input.

24. The method of claim 22, wherein the estimating includes combining the audio output signal and the at least one predetermined calibration setting to generate a resulting waveform, and the removing includes applying data representative of the resulting waveform to the audio input.

25. The method of claim 1, wherein the estimating includes using the at least one calibration setting to account for at least one difference between the subsequent audio output signal provided to the television device and the subsequent audio content broadcast by the television device.

26. The method of claim 25, wherein the at least one difference between the subsequent audio output signal provided to the television device and the subsequent audio content broadcast by the television device includes at least one base-level frequency that has been accentuated by the television device.

* * * * *